US006515419B1

(12) United States Patent
Lee et al.

(10) Patent No.: US 6,515,419 B1
(45) Date of Patent: Feb. 4, 2003

(54) PLASMA DISPLAY PANEL WITH BARRIERS AND ELECTRODES HAVING DIFFERENT WIDTHS DEPENDING ON THE DISCHARGE CELL

(75) Inventors: Eun Cheol Lee, Kyongsangbuk-do (KR); Chung Huan Jeon, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 09/620,601

(22) Filed: Jul. 20, 2000

(30) Foreign Application Priority Data

Jul. 23, 1999 (KR) ..... 99-30025
Nov. 18, 1999 (KR) ..... 99-51357

(51) Int. Cl.[7] ..... H01J 17/49
(52) U.S. Cl. ..... 313/582; 313/584; 313/583
(58) Field of Search ..... 313/582, 583, 313/584, 586, 587, 585

(56) References Cited

U.S. PATENT DOCUMENTS 4,352,042 A * 9/1982 Lorenz et al. ..... 313/485
5,136,207 A * 8/1992 Lorenz et al. ..... 313/485
5,159,238 A * 10/1992 Koiwa et al. ..... 313/582
5,477,105 A * 12/1995 Curtin et al. ..... 313/422
5,504,387 A * 4/1996 Hamagishi et al. ..... 313/310
5,703,433 A * 12/1997 Fujii et al. ..... 313/484
5,736,815 A * 4/1998 Amemiya ..... 313/586
5,744,909 A * 4/1998 Amano ..... 313/585
5,754,003 A * 5/1998 Murai et al. ..... 313/582
5,763,139 A * 6/1998 Matsunaga et al. ..... 430/313
5,859,508 A * 1/1999 Ge et al. ..... 315/366
6,008,582 A * 12/1999 Asano et al. ..... 313/582
6,013,974 A * 1/2000 Haven et al. ..... 313/309
6,160,348 A * 12/2000 Choi ..... 313/584
6,249,264 B1 * 6/2001 Sano et al. ..... 345/60

FOREIGN PATENT DOCUMENTS

KR 1998-018375 7/1998

* cited by examiner

*Primary Examiner*—Vip Patel
*Assistant Examiner*—Kevin Quarterman
(74) *Attorney, Agent, or Firm*—Fleshner & Kim, LLP

(57) ABSTRACT

A plasma display panel in which a white colored screen has an improved picture quality includes: a plurality of first barriers successively formed on a predetermined substrate at constant intervals; a plurality of sustain electrodes successively formed to be orthogonal to the first barriers to form discharge cells between the respective first barriers; and a plurality of second barriers respectively formed between a pair of the sustain electrodes in parallel to the sustain electrodes, having different widths depending on the discharge cell displaying red, the discharge cell displaying green and the discharge cell displaying blue.

29 Claims, 10 Drawing Sheets

FIG. 8

PLASMA DISPLAY PANEL WITH BARRIERS AND ELECTRODES HAVING DIFFERENT WIDTHS DEPENDING ON THE DISCHARGE CELL

BACKGROUND OF THE INVENTION

1. Field of the Invention

The present invention relates to a plasma display panel.

2. Discussion of the Related Art

Generally, a plasma display panel and a liquid crystal display (LCD) have lately attracted considerable attention as the most practical next generation display of flat panel displays. In particular, the plasma display panel has higher luminance and a wider viewing angle than the LCD. For this reason, the plasma display panel is widely used as a thin type large display such as an outdoor advertising tower, a wall TV and a theater display.

A related art plasma display panel of three-electrode area discharge type will be described with reference to the accompanying drawings.

As shown in FIG. 1*a*, the related art plasma display panel of three-electrode area discharge type includes an upper substrate 10 and a lower substrate 20 which face each other. In FIG. 1*b*, the lower substrate 20 is rotated by 90°.

The upper substrate 10 includes a plurality of scan electrodes 16 and 16', a plurality of sustain electrodes 17 and 17', a dielectric layer 11, and a passivation film 12. The scan electrodes 16 and 16' are formed at certain intervals in parallel to the sustain electrodes 17 and 17'. The dielectric layer 11 is deposited on the scan electrodes 16 and 16' and the sustain electrodes 17 and 17'.

The lower substrate 20 includes a plurality of address electrodes 22, a dielectric film 21 formed on an entire surface of the substrate including the address electrodes 22, a plurality of barriers 23 formed on the dielectric film 21 between the respective address electrodes, and a phosphor 24 formed on surfaces of the barriers 23 in each discharge cell and of the dielectric film 21.

Inert gases such as He and Xe are mixed in a space between the upper substrate 10 and the lower substrate 20 at a pressure of 400 to 500 Torr. The space forms a discharge area.

The scan electrodes 16 and 16' and the sustain electrodes 17 and 17' are of transparent electrodes and bus electrodes of metals so as to increase optical transmitivity of each discharge cell, as shown in FIGS. 2*a* and 2*b*. That is to say, the electrodes 16 and 17 are of transparent electrodes while the electrodes 16' and 17' are of bus electrodes.

FIG. 2*a* is a plane view of the sustain electrodes 17 and 17' and the scan electrodes 16 and 16', and FIG. 2*b* is a sectional view of the sustain electrodes 17 and 17' and the scan electrodes 6 and 16'.

A discharge voltage from an externally provided driving integrated circuit (IC) is applied to the bus electrodes 16' and 17'. The discharge voltage applied to the bus electrodes 16' and 17' is applied to the transparent electrodes 16 and 17 to generate discharge between the adjacent transparent electrodes 16 and 17. The transparent electrodes 16 and 17 have an overall width of about 300 $\mu$m and are made of indium oxide or tin oxide. The bus electrodes 16' and 17' are formed of a three-layered thin film of Cr—Cu—Cr. At this time, the bus electrodes 16' and 17' have a line width of ⅓ of a line width of the transparent electrodes 16 and 17.

The operation of the aforementioned AC type plasma display panel of three-electrode area discharge type will be described with reference to FIGS. 3*a* to 3*d*.

If a driving voltage is applied between each address electrode and each scan electrode, opposite discharge occurs between the address electrode and the scan electrode as shown in FIG. 3*a*. The inert gas injected into the discharge cell is instantaneously excited by the opposite discharge. If the inert gas is again transited to the ground state, ions are generated. The generated ions or some electrons of quasi-excited state come into collision with a surface of the passivation film as shown in FIG. 3*b*. The collision of the electrons secondarily discharges electrons from the surface of the passivation film. The secondarily discharged electrons come into collision with a plasma gas to diffuse the discharge. If the opposite discharge between the address electrode and the scan electrode ends, wall charges having opposite polarities occur on the surface of the passivation film on the respective address electrode and the scan electrode, as shown in FIG. 3*c*.

If the discharge voltages having opposite polarities are continuously applied to the scan electrode and the sustain electrode and at the same time the driving voltage applied to the address electrode is cut off, area discharge occurs in a discharge area on the surfaces of the dielectric layer and the passivation film due to potential difference between the scan electrode and the sustain electrode as shown in FIG. 3*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrode and the barrier so that the phosphors are excited. The excited phosphors generate visible light rays, and the visible light rays display an image on a screen. That is, the plasma display panel is operated.

At this time, luminance of the plasma display panel is proportional to discharge current between the scan electrode and the sustain electrode. Accordingly, if the discharge current is great, the screen of the plasma display panel becomes bright. Also, the wider the distance between the scan electrode and the sustain electrode is, the higher luminance of the plasma display panel is. This is because that the discharge distance between the electrodes increases so that ultraviolet rays in a positive column region are generated.

A white colored screen displayed by the plasma display panel is determined by luminance ratio of a red discharge cell, a green discharge cell and a blue discharge cell. At this time, picture quality of the white colored screen becomes clearer if a color temperature is high.

A luminance ratio of phosphors formed in discharge cells of the related art plasma display panel has a value of 2:3:1 in the order of red, green and blue.

Accordingly, if all the discharge cells are discharged to display white color, pure white color is not clear and a color temperature is about 5000°.

However, the plasma display panel has lower luminance than that of a discharge tube such as a fluorescent lamp and a neon lamp, it is not sufficient for a next generation display device to substitute a CRT. This is because that the discharge cell formed in the plasma display panel has a short distance between the discharge electrodes as compared with a discharge tube such as a neon lamp and a fluorescent lamp, thereby resulting in that ultraviolet rays in a positive column region having good light-emitting efficiency are not utilized.

Furthermore, the related art plasma display panel has a problem that picture quality of a white colored screen is poor because the luminance ratio of the discharge cell having a red phosphor, the discharge cell having a blue phosphor and the discharge cell having a green phosphor is different. That is, since light-emitting luminance of the green phosphor is higher than that of the red phosphor and light-emitting luminance of the blue phosphor is lower than that of the red phosphor, purity of white color is lowered.

SUMMARY OF THE INVENTION

Accordingly, the present invention is directed to a plasma display panel that substantially obviates one or more of the problems due to limitations and disadvantages of the related art.

An object of the present invention is to provide a plasma display panel having higher light-emitting luminance and efficiency.

Another object of the present invention is to provide a plasma display panel in which a white colored screen has an improved picture quality by controlling luminance ratio of each discharge cell.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a plasma display panel according to the present invention includes: a plurality of first barriers successively formed on a predetermined substrate at constant intervals; a plurality of sustain electrodes successively formed to be orthogonal to the first barriers to form discharge cells between the respective first barriers; and a plurality of second barriers respectively formed between a pair of the sustain electrodes in parallel to the sustain electrodes, having different widths depending on the discharge cell displaying red, the discharge cell displaying green and the discharge cell displaying blue.

In another aspect, a plasma display panel according to the present invention includes: a plurality of barriers successively formed on a predetermined substrate at constant intervals; a plurality of first sustain electrodes successively formed to be orthogonal to the barriers, having a first width in a discharge cell displaying red, a second width in a discharge cell displaying green and a third width in a discharge cell displaying blue; and a plurality of second sustain electrodes formed in parallel to the first sustain electrodes and mated with the first sustain electrodes one by one.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Figure 1A:
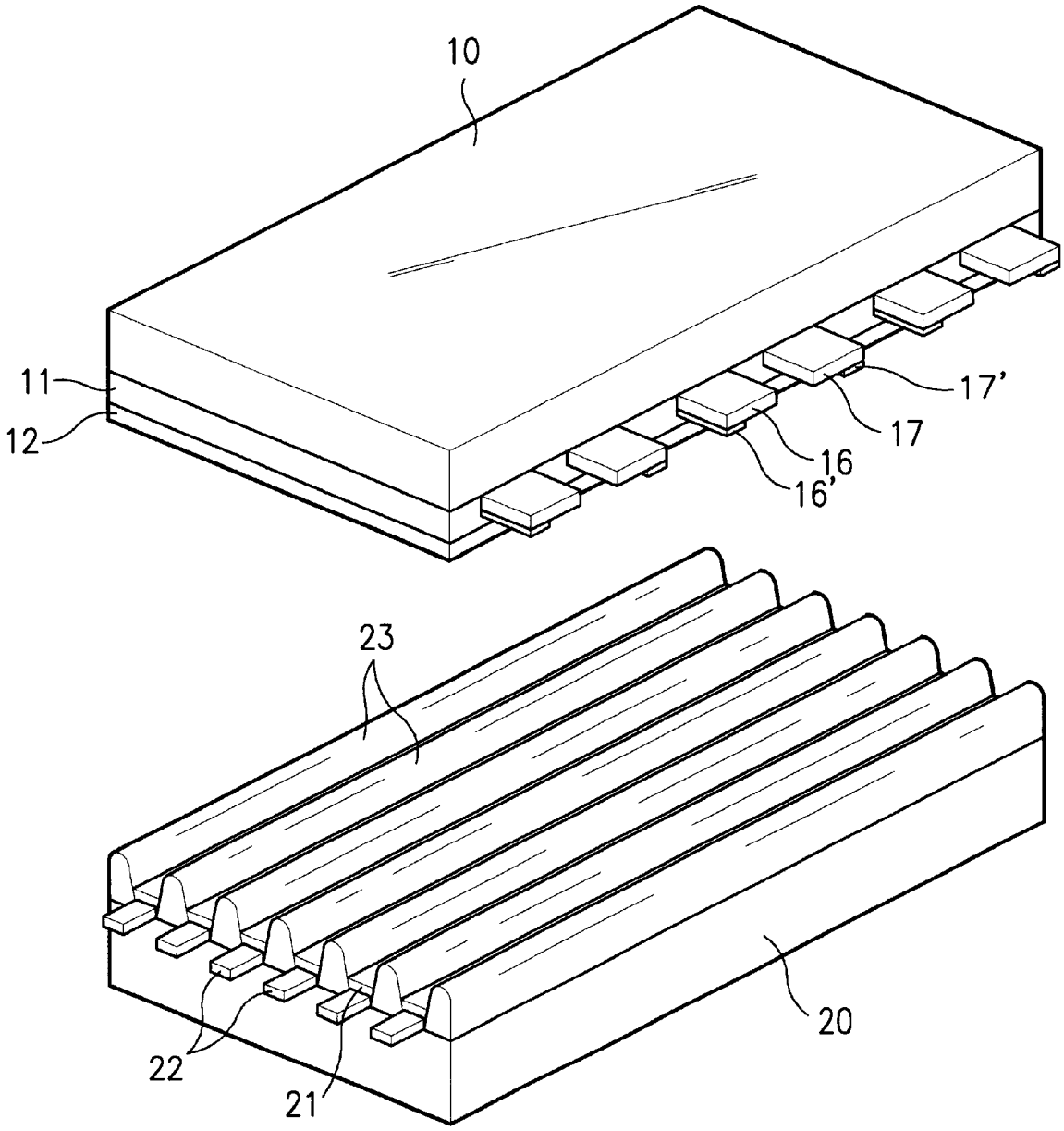
FIG. 1A Prior Art
FIG. 1*a* is a perspective view of a general plasma display panel.
Figure 1B:
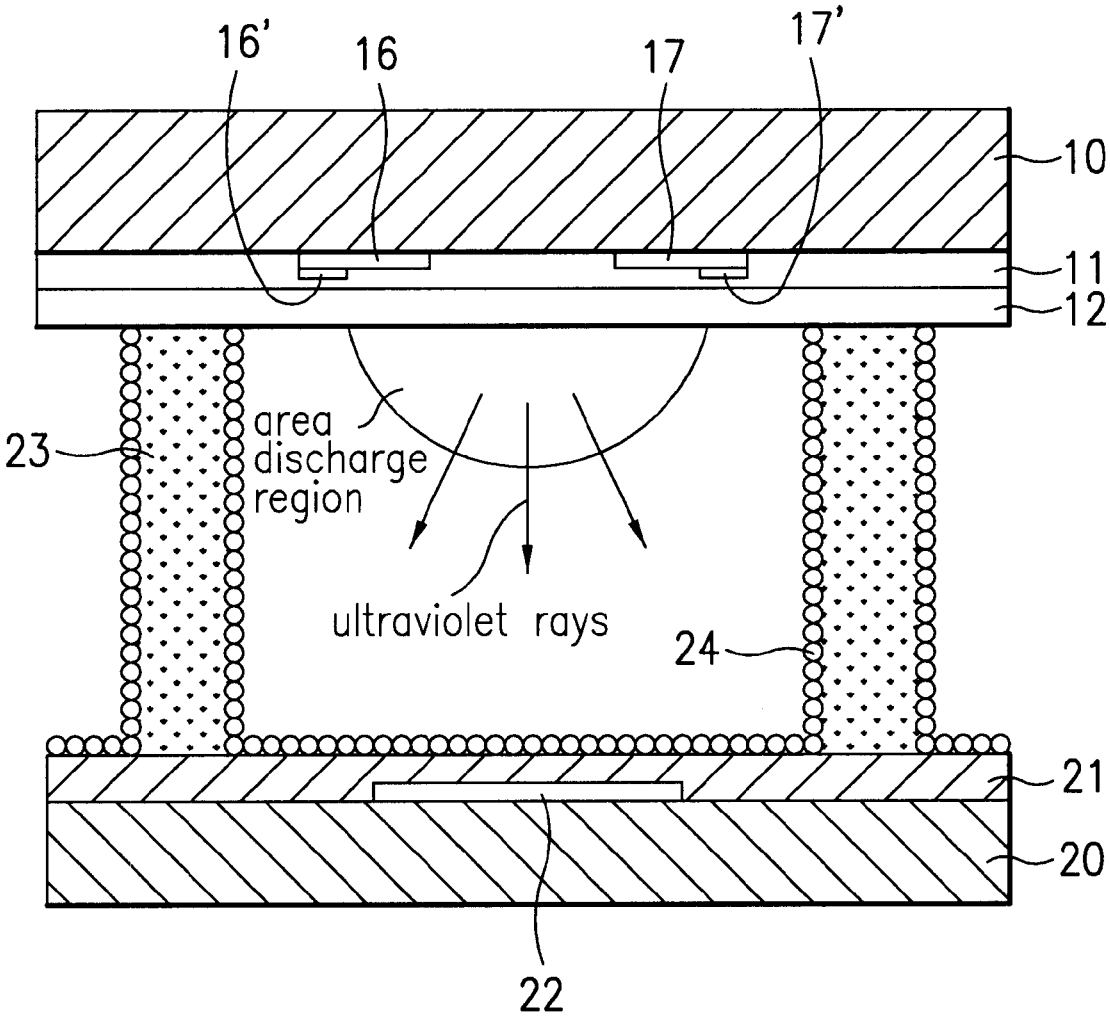
FIG. 1B Prior Art
FIG. 1*b* is a sectional view of the general plasma display panel of FIG. 1*a;*
Figure 2A:
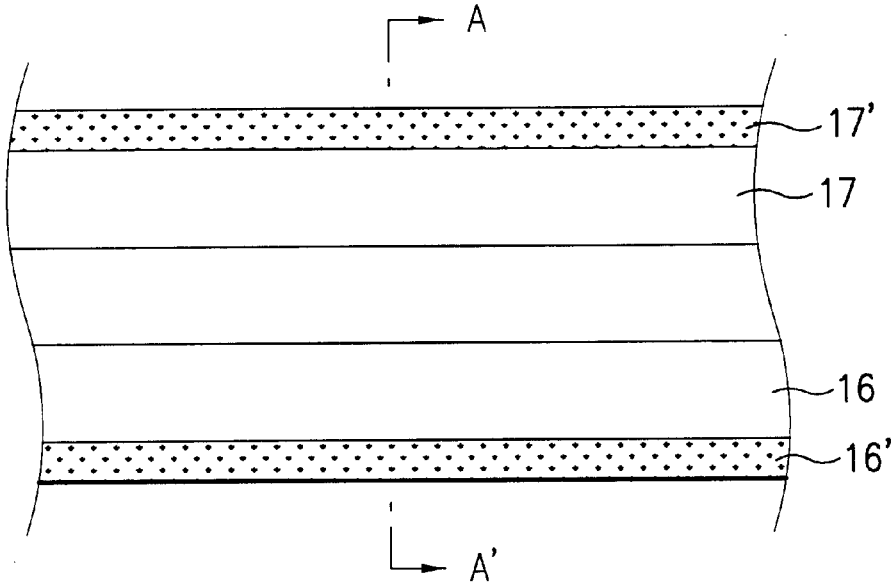
FIG. 2A Prior Art
FIG. 2*a* is a plane view of a sustain electrode formed on an upper substrate of a related art plasma display panel.
Figure 2B:
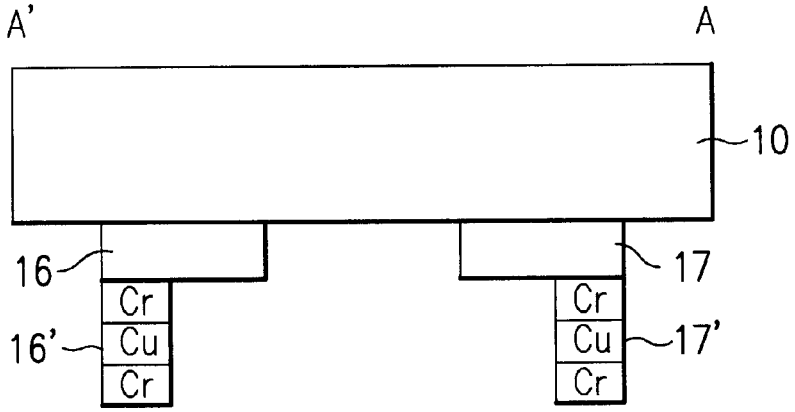
FIG. 2B Prior Art
FIG. 2*b* is a sectional view of a sustain electrode formed on the upper substrate of FIG. 3.
Figure 3A:
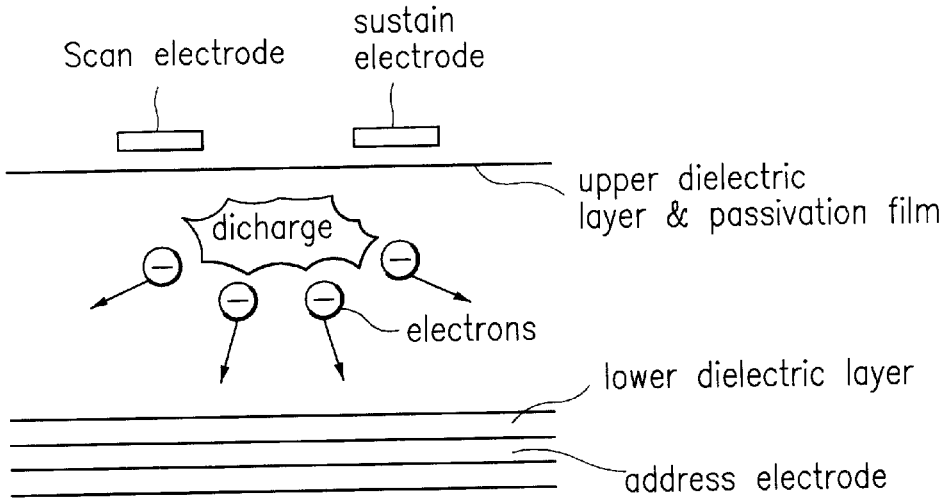
FIG. 3A Prior Art
FIGS. 3*a* to 3*d* are sectional views illustrating the operation of a discharge cell in a writing discharge section of the related art plasma display panel.
Figure 3B:
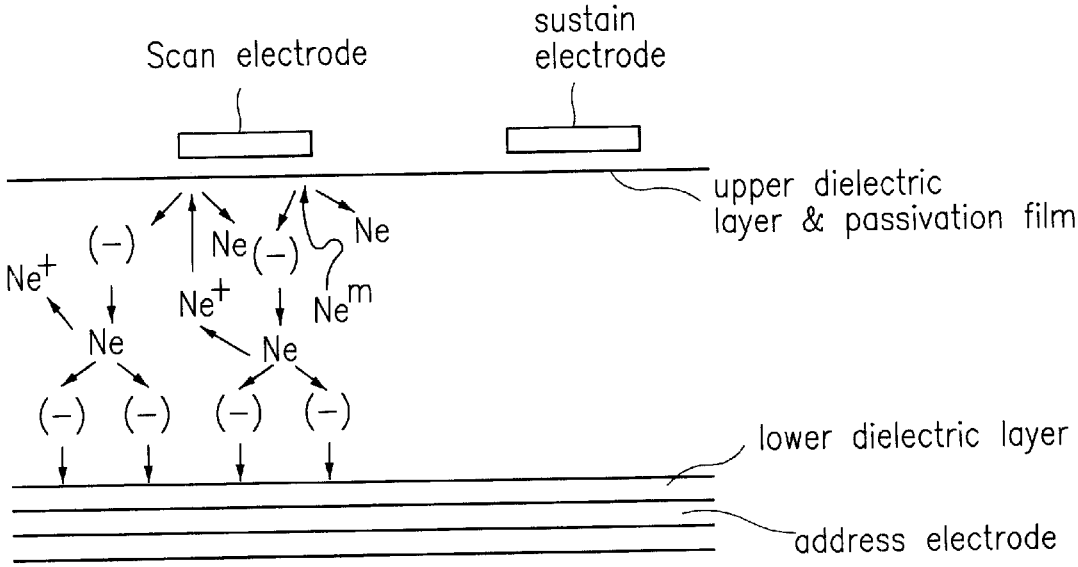
FIG. 3B Prior Art
Figure 3C:
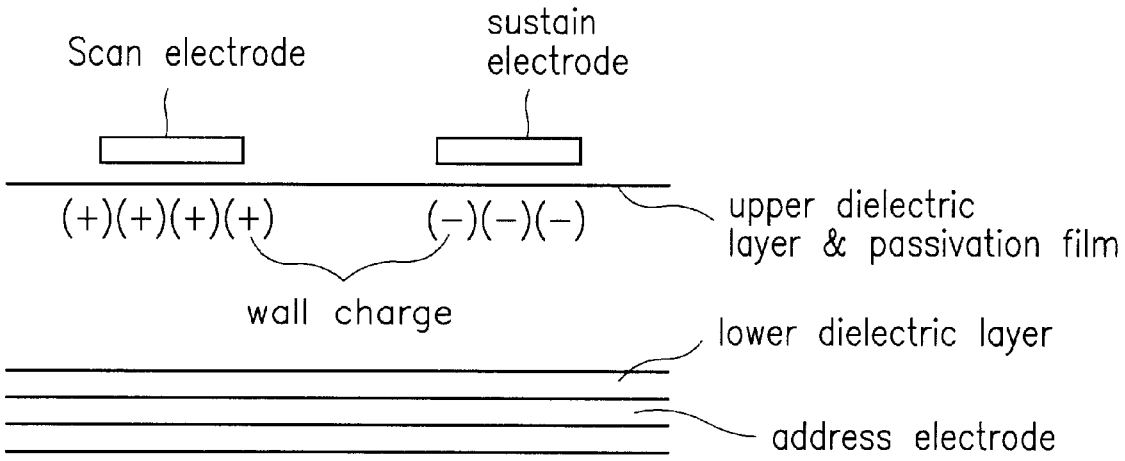
FIG. 3C Prior Art
Figure 3D:
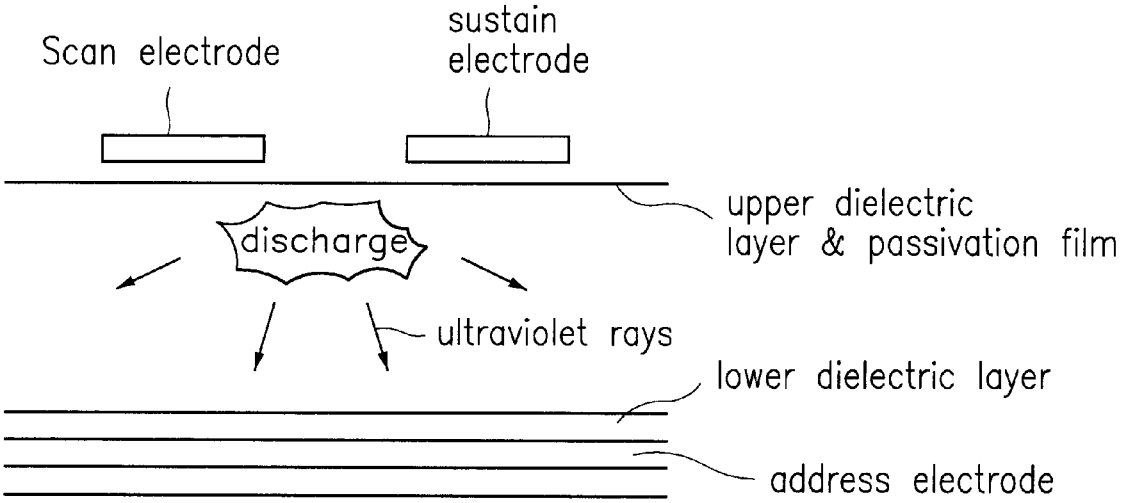
FIG. 3D Prior Art
Figure 4:
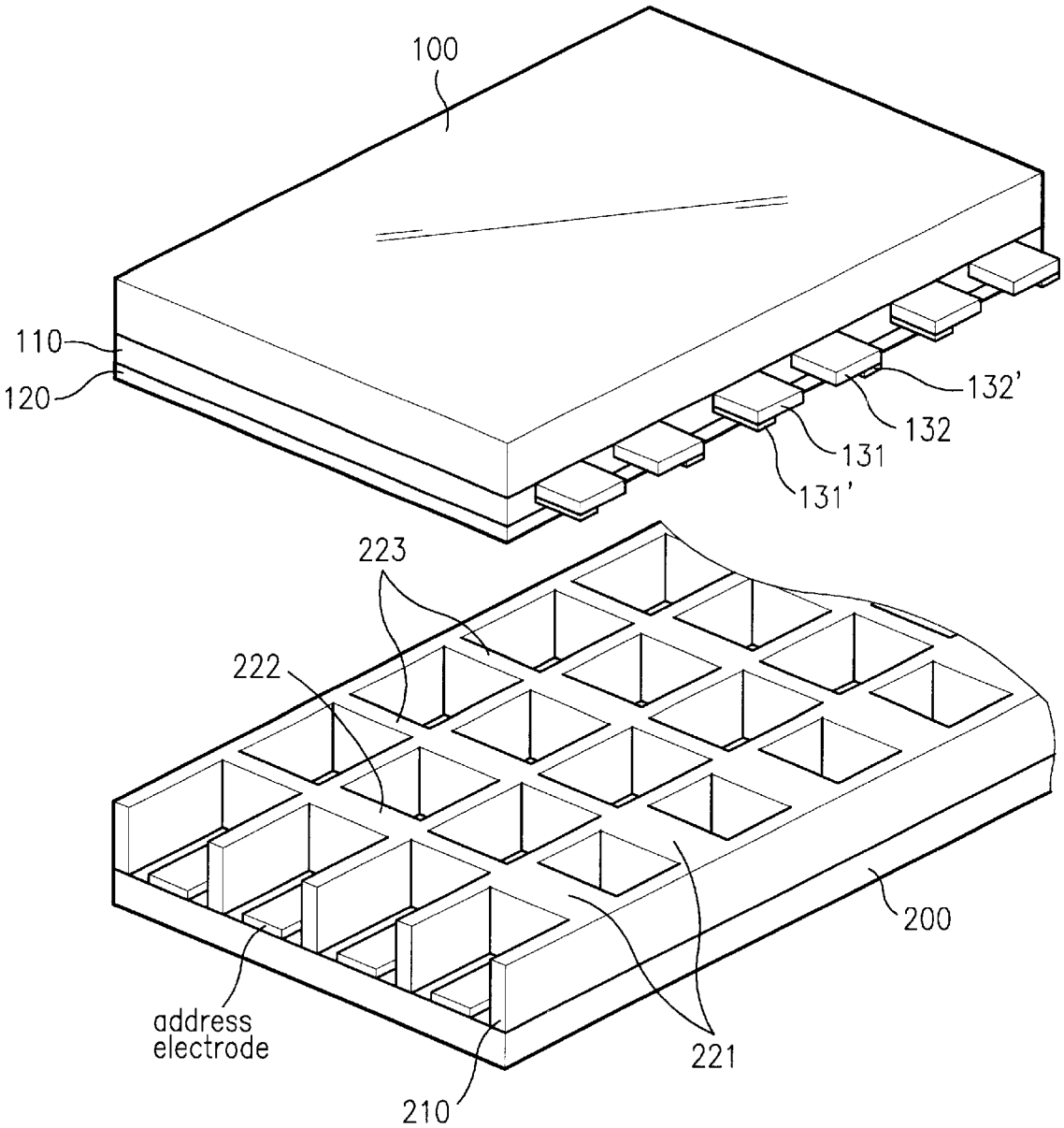
FIG. 4 is a perspective view illustrating a plasma display panel according to the present invention.
Figure 5:
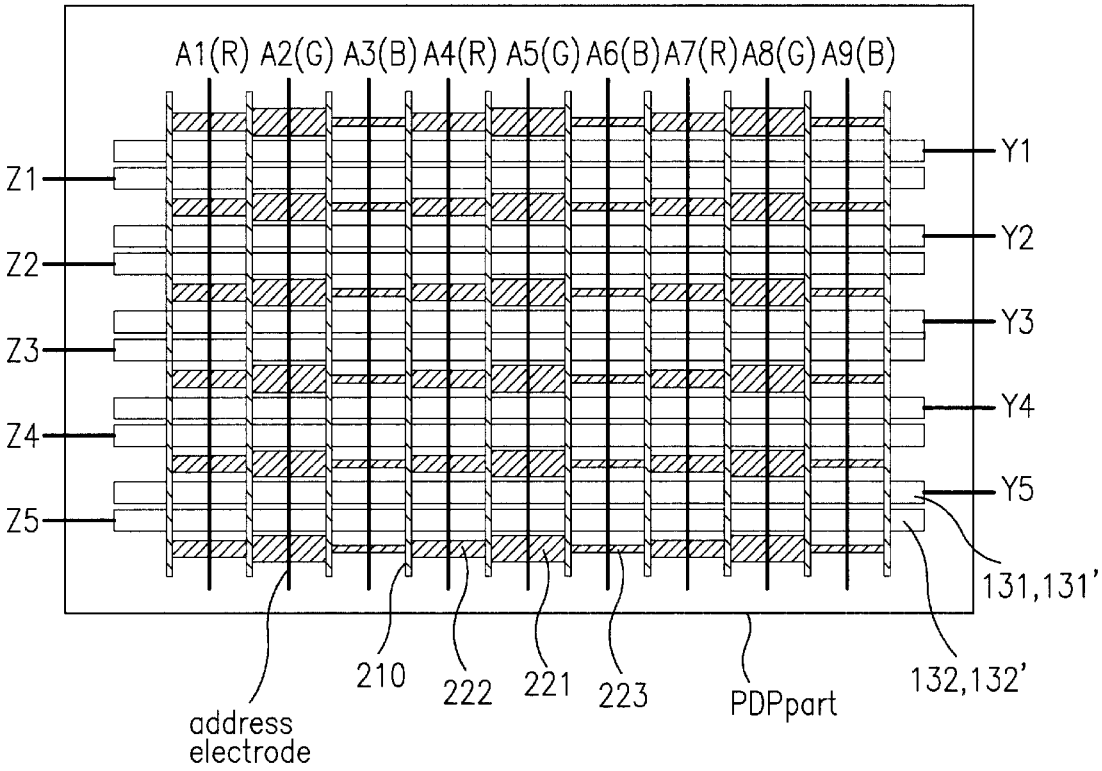
FIG. 5 is a plane view illustrating the plasma display panel of FIG. 4.

Reference will now be made in detail to the preferred embodiments of the present invention, examples of which are illustrated in the accompanying drawings.

A plasma display panel of the present invention includes a plurality of first barriers 210 successively formed on a predetermined substrate at constant intervals. The first barriers 210 are generally formed on a lower substrate 200. The first barriers 210 may be formed on an upper substrate 100 as the case may be.

A plurality of sustain electrodes are successively formed to be orthogonal to the first barriers 210. The sustain electrodes includes first sustain electrodes 131 and 131' and second sustain electrodes 132 and 132'. These first and second sustain electrodes constitute a pair. One of a plurality of discharge cells is formed by these first and second sustain electrodes. The discharge cells are isolated from one another by the first barriers 210.

At this time, the plasma display panel of the present invention may further include a dielectric layer 110 and a passivation film 120 on the sustain electrodes. The respective sustain electrodes are of transparent electrodes 131 and 132 and metal electrodes 131' and 132'.

A second barrier is respectively formed between a pair consisting of the first sustain electrodes 131 and 131' and the second sustain electrodes 132 and 132' and another pair consisting of the first sustain electrodes 131 and 131' and the second sustain electrodes 132 and 132'. The second barrier is parallel to the sustain electrodes.

Particularly, the second barrier has different widths depending on a discharge cell displaying red, a discharge cell displaying green and a discharge cell displaying blue.

The second barrier includes a third barrier 221 formed in a discharge cell displaying green at a first width, a fourth barrier 222 formed in a discharge cell displaying red at a second width narrower than the first width, and a fifth barrier 223 formed in a discharge cell displaying blue at a third width smaller than the second width. In this case, the third barrier 221 is 1.1 to 2 times wider than the fourth barrier 222, and the fifth barrier 223 is 0.5 to 0.9 times the width of the fourth barrier 222.

In the plasma display panel of the present invention, the third, fourth and fifth barriers 221, 222 and 223 parallel to the sustain electrodes have different widths depending on the phosphors formed in the discharge cells. Accordingly, a color temperature can be maintained at 8000° or more, thereby improving purity of white color.

That is to say, since the discharge cell displaying green is the narrowest and the discharge cell displaying blue is the widest, luminance ratio of green against red becomes lower and luminance ratio of blue against red becomes higher. As a result, disproportional luminance between green and blue is removed, thereby improving purity of white color.

First Embodiment

Figure 6:
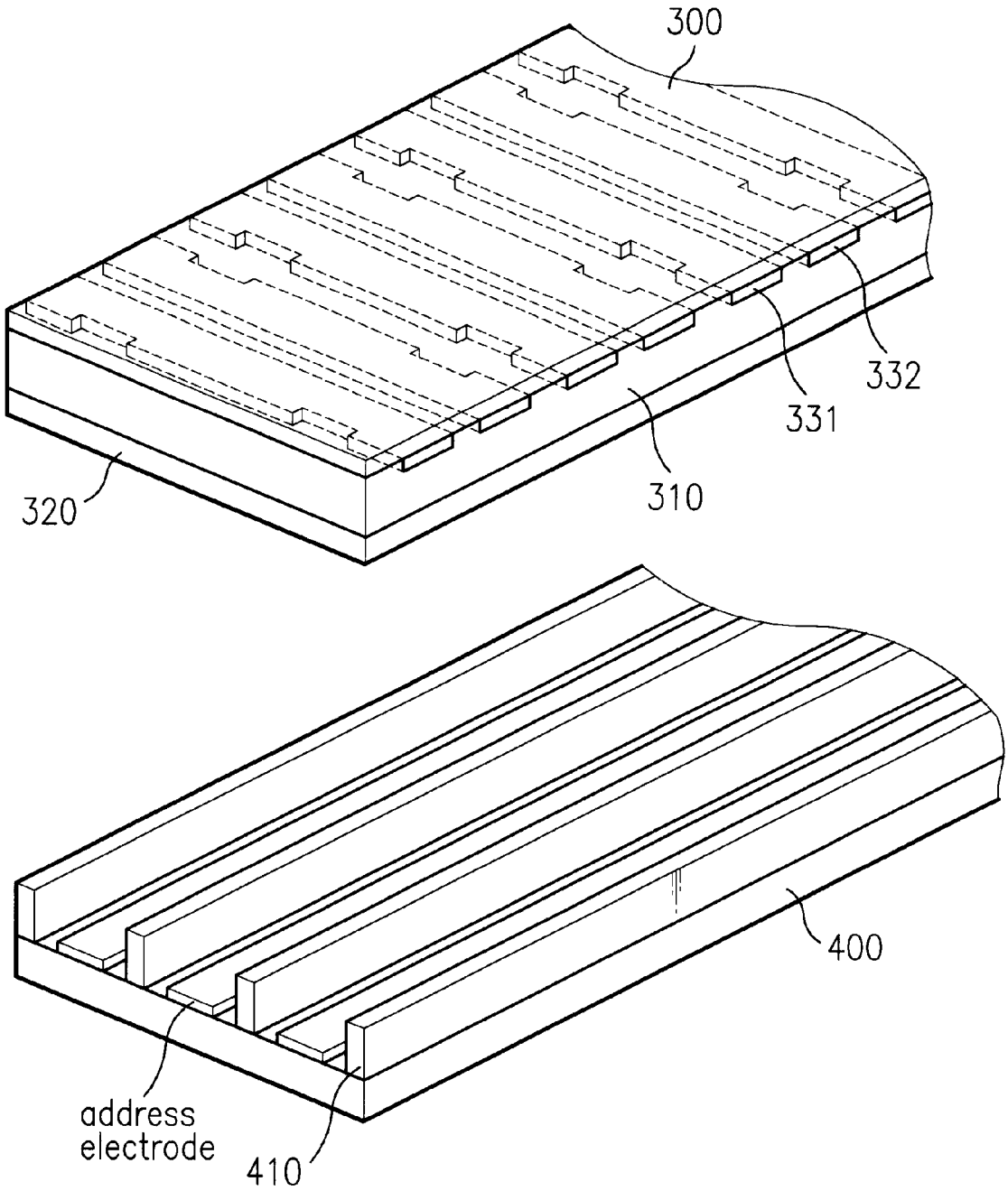
FIG. 6 is a perspective view illustrating a plasma display panel according to the first embodiment of the present invention.

A plasma display panel according to the first embodiment of the present invention will be described with reference to FIGS. 6 and 7.

Barriers 410 are successively formed on a predetermined substrate at constant intervals, and discharge cells are respectively formed in regions between the respective barriers 410. Each of the discharge cell includes a pair of first and second sustain electrodes.

The barriers 410 have a stripe shape, or a lattice shape to divide each discharge cell.

The lattice shaped barriers 410 further include sub-barriers 420 successively formed to be orthogonal to the barriers 410 to divide the first and second sustain electrodes 331 and 332 in pairs.

Generally, the barriers 410 are formed on the lower substrate 400, and the sustain electrodes are formed on the upper substrate 300.

Furthermore, the plasma display panel of the present invention may further include a dielectric layer 310 and a passivation film 320 on the sustain electrodes in the same manner as the related art.

The first and second sustain electrodes 331 and 332 are formed to be orthogonal to the stripe shaped barriers 410.

Each of the first sustain electrodes 331 is formed in such a manner that the discharge cell displaying red has a first width, the discharge cell displaying green has a second width, and the discharge cell displaying blue has a third width.

Preferably, the first width is in the range of 70% to 90% of the second width and the third width is the same as the second width.

Also, the second sustain electrode 332 is preferably formed with the same shape as the first sustain electrode 331. That is to say, each of the second sustain electrodes 332 is formed in such a manner that the discharge cell displaying red has a fourth width, the discharge cell displaying green has a fifth width, and the discharge cell displaying blue has a sixth width.

Preferably, the fourth width is the same as the first width, the fifth width is the same as the second width, and the sixth width is the same as the third width.

In the plasma display panel of the present invention, the sustain electrodes have different widths depending on the phosphors of the discharge cells. Particularly, since a portion of the sustain electrode disposed in the discharge cell displaying red is narrower than the other portions, light-emitting luminance of the discharge cell displaying red is reduced.

Thus, luminance of the red phosphor higher than those of the blue phosphor and the green phosphor emitting under the same discharge voltage becomes lower. Luminance difference of blue, green and red is reduced, thereby improving purity of white color.

The aforementioned plasma display panel can be realized by various embodiments depending on arrangement relationship of the sustain electrodes.

Second Embodiment

In a plasma display panel according to the second embodiment of the present invention, the first sustain electrodes 331 and the second sustain electrodes 332 are alternately formed.

Figure 7:
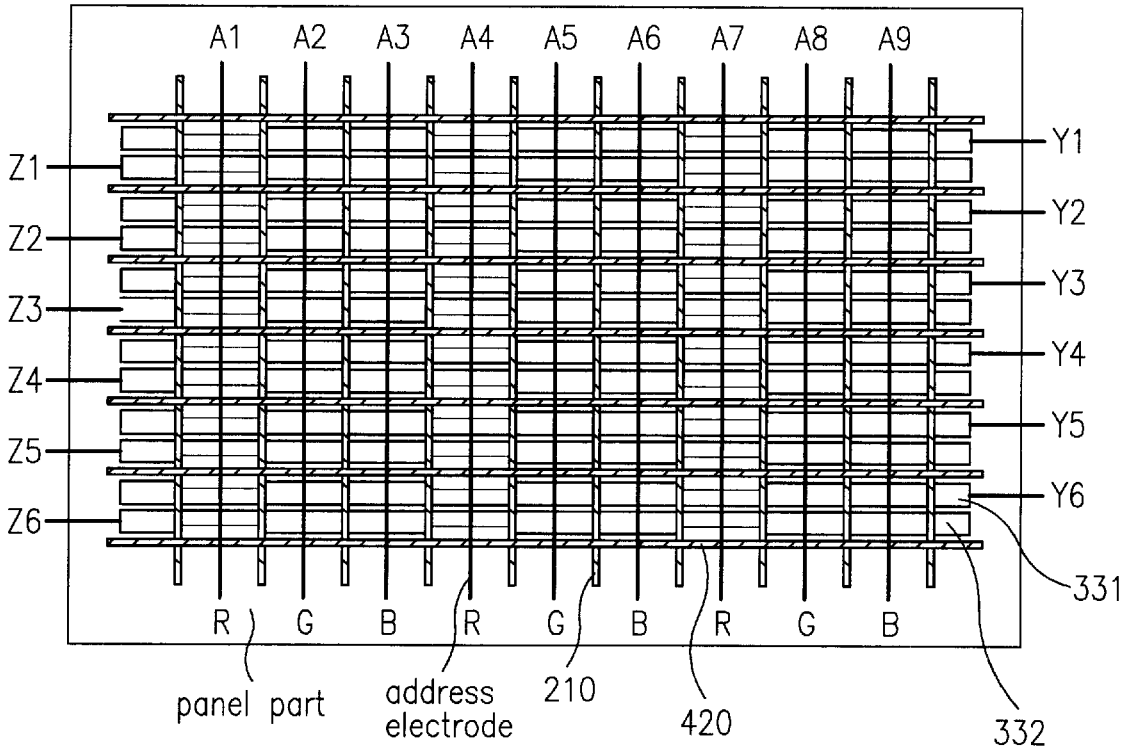
FIG. 7 is a plane view illustrating a plasma display panel according to the second embodiment of the present invention.

If a scan pulse is applied to the first sustain electrodes 331 and a sustain pulse is applied to the second sustain electrodes 332, the first sustain electrodes 331 and the second sustain electrodes 332 are alternately formed as shown in FIG. 7.

Generally, barriers 410 dividing pixels have a stripe shape. The barriers 410 may have a lattice shape as shown in FIG. 7.

The lattice shaped barriers 410 further include sub-barriers 420 successively formed to be orthogonal to the main barriers to divide the first and second sustain electrodes 331 and 332 in pairs.

Third Embodiment

In a plasma display panel according to the third embodiment of the present invention, the first sustain electrodes 332 are mated with the second sustain electrodes 331 one by one. That is, in the plasma display panel according to the second embodiment of the present invention, the first sustain electrodes 331 and the second sustain electrodes 332 are alternately formed. On the other hand, in the plasma display panel according to the third embodiment of the present invention, a pair of sustain electrodes formed in one discharge cell are alternately formed.

Figure 8:
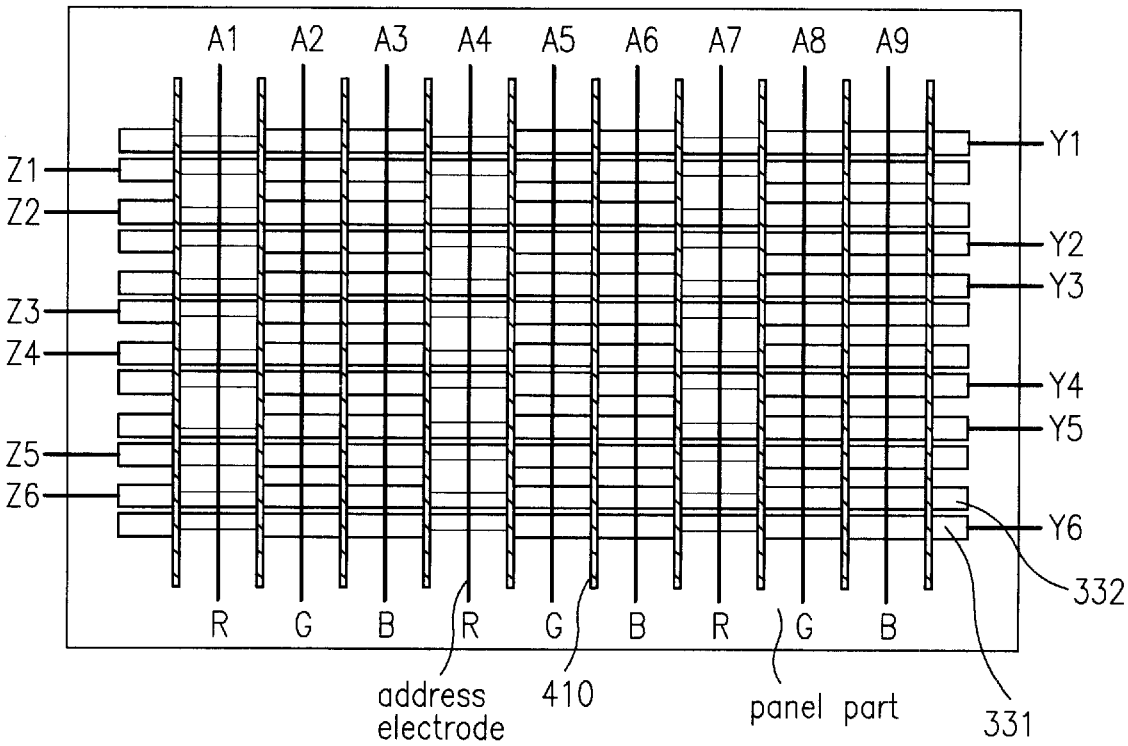
FIG. 8 is a plane view illustrating a plasma display panel according to the third embodiment of the present invention.

If a scan pulse is applied to the first sustain electrodes 331 and a sustain pulse is applied to the second sustain electrodes 332, a pair of the first sustain electrode 331 and the second sustain electrode 332 are adjacent to another pair of the first sustain electrode 331 and the second sustain electrode 332 as shown in FIG. 8. If a pair of the sustain electrodes in a discharge cell are formed in the order of the first sustain electrode 331 and the second sustain electrode 332, another pair of the sustain electrodes in an adjacent discharge cell are formed in the order of the second sustain electrode 332 and the first sustain electrode 331.

However, in the plasma display panel according to the third embodiment of the present invention, the distance between a pair of the first sustain electrodes or the distance between a pair of the second sustain electrodes is closer than the distance between adjacent pairs, i.e., the distance between the first sustain electrode 331 and the second sustain electrode 332.

The barriers 410 act to isolate a pair of the first sustain electrodes 331 or a pair of the second sustain electrodes 332 from adjacent pairs.

The pair consisting of the first sustain electrodes 331 and the second sustain electrodes 332 constitutes a discharge cell. The respective discharge cells are isolated from one another by the barriers 410.

Figure 9:
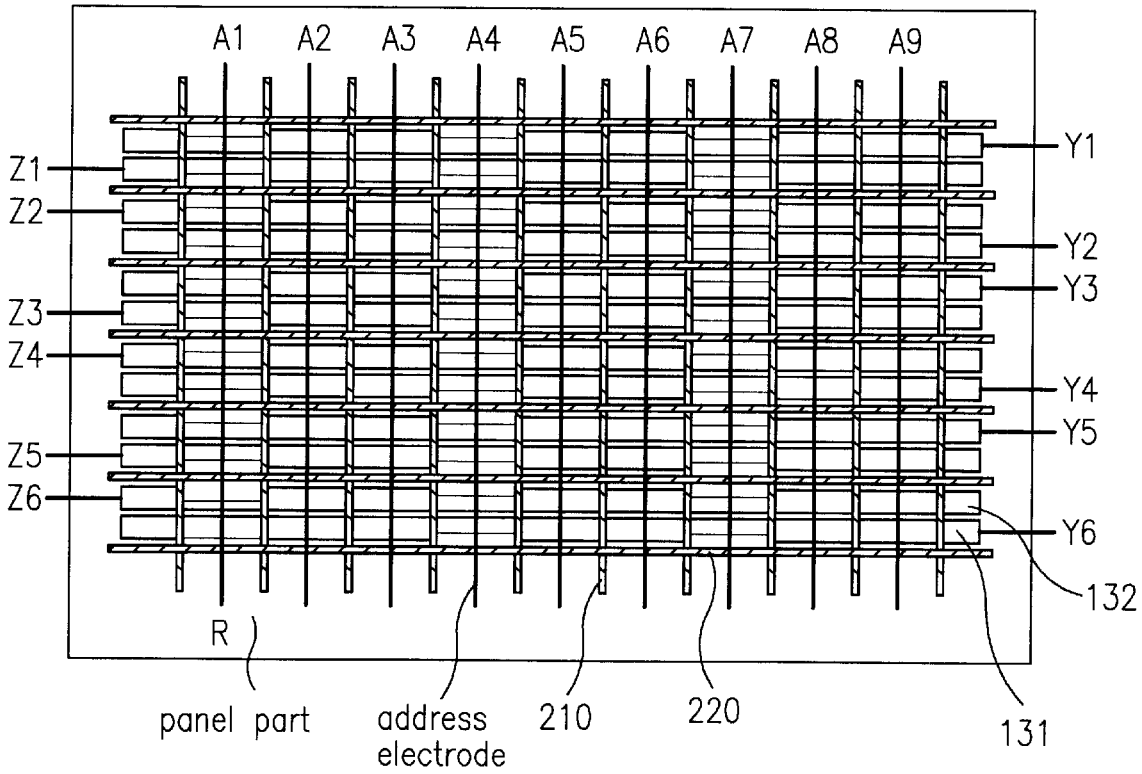
FIG. 9 is a plane view illustrating another plasma display panel according to the third embodiment of the present invention.

Generally, the barriers 410 dividing pixels have a stripe shape. The barriers 410 may have a lattice shape as shown in FIG. 9.

The lattice shaped barriers 410 further include sub-barriers 420 successively formed to be orthogonal to the main barriers to divide the first and second sustain electrodes 331 and 332 in pairs.

As aforementioned, the plasma display panel of the present invention has the following advantages.

Since uniform luminance between the discharge cell displaying red, the discharge cell displaying green, and the discharge cell displaying blue is obtained, purity of white color is improved.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel comprising:

a plurality of first barriers successively formed on a predetermined substrate at constant intervals; and a plurality of second barriers formed orthogonal to the plurality of first barriers, wherein the second barriers comprise a first width when a corresponding discharge cell to the second barrier is for displaying green, a second width when the corresponding discharge cell to the second barrier is for displaying red and a third width when the corresponding discharge cell to the second barrier is for displaying blue, wherein at least one of the first, second and third widths is different from at least one of the other first, second and third widths.

2. The plasma display panel as claimed in claim 1, wherein the second width is narrower than the first width and the third width is smaller than the second width.

3. The plasma display panel as claimed in claim 2, wherein the first width is 1.1 to 2 times the width of the second width.

4. The plasma display panel as claimed in claim 2, wherein the third width is 0.5 to 0.9 times the width of the first width.

5. A plasma display panel comprising:

a plurality of barriers successively formed on a predetermined substrate at constant intervals; and a plurality of first sustain electrodes successively formed to be orthogonal to the barriers to form discharge cells, wherein a discharge cell displaying red has a corresponding sustain electrode with a first width, a discharge cell displaying green has a corresponding sustain electrode with a second width and a discharge cell displaying blue has a corresponding sustain electrode with a third width, wherein at least one of the first, second and third widths is different from at least one other width of the first, second and third widths.

6. The plasma display panel as claimed in claim 5, wherein the first width is in the range of 70% to 90% of the second width.

7. The plasma display panel as claimed in claim 5, wherein the third width is approximately the same width as the second width.

8. The plasma display panel as claimed in claim 5, further comprising a plurality of second sustain electrodes formed in parallel to the first sustain electrodes and mated with the first sustain electrodes, wherein the second sustain electrodes have a fourth width in a discharge cell displaying red, which is a different width from at least one of the first, second and third widths.

9. The plasma display panel as claimed in claim 8, wherein the fourth width is approximately the same width as the first width.

10. The plasma display panel as claimed in claim 5, further comprising a plurality of second sustain electrodes formed in parallel to the first sustain electrodes and mated with the first sustain electrodes, wherein the second sustain electrodes have a fifth width in a discharge cell displaying green, which is a different width from at least one of the first, second and third widths.

11. The plasma display panel as claimed in claim 10, wherein the fifth width is approximately the same width as the second width.

12. The plasma display panel as claimed in claim 5, further comprising a plurality of second sustain electrodes formed in parallel to the first sustain electrodes and mated with the first sustain electrodes, wherein the second sustain electrodes have a sixth width in a discharge cell displaying blue, which is a different width from at least one of the first, second or third widths.

13. The plasma display panel as claimed in claim 12, wherein the sixth width is approximately the same width as the third width.

14. The plasma display panel as claimed in claim 5, further comprising a plurality of second sustain electrodes formed in parallel to the first sustain electrodes and mated with the first sustain electrodes, wherein the first and second sustain electrodes are alternately formed.

15. The plasma display panel as claimed in claim 5, further comprising a plurality of second sustain electrodes formed in parallel to the first sustain electrodes and mated with the first sustain electrodes, wherein a pair of the first sustain electrodes are adjacent to a pair of the second sustain electrodes.

16. The plasma display panel as claimed in claim 14 or 15, further comprising sub-barriers successively formed to be orthogonal to the barriers so as to divide the first and second sustain electrodes in pairs.

17. The plasma display panel as claimed in claim 1, wherein the first width is wider than the second width to reduce the luminance difference between the green and red discharge cells.

18. The plasma display panel as claimed in claim 1, wherein the third width is smaller than the second width to reduce the luminance difference between the blue and red discharge cells.

19. The plasma display panel as claimed in claim 1, wherein the first width is wider than the second width, which in turn is wider than the third width to reduce the luminance difference of the green, red and blue discharge cells and increase the purity of a white luminance display.

20. The plasma display panel as claimed in claim 5, wherein the width of the third width is smaller than the widths of the first and/or second widths.

21. A plasma display panel, comprising:

an upper substrate;

a lower substrate facing the upper substrate;

a plurality of sustain electrodes on the upper substrate;

a plurality of address electrodes on the lower substrate;

a plurality of barriers formed on the lower substrate to define a plurality of discharge cells, wherein a discharge cell is defined by four walls formed by the barriers, and wherein at least one wall in at least one discharge cell has a different thickness relative to the other walls based on a color assigned to the discharge cell.

22. The plasma display panel as claimed in claim 21, wherein a green discharge cell has at least one wall thicker than at least three walls in a red or a blue discharge cell.

23. The plasma display panel as claimed in claim 21, wherein a red discharge cell has at least one wall thicker than at least three walls in a blue discharge cell.

24. The plasma display panel as claimed in claim 21, wherein at least one wall in a green discharge cell is wider than walls in a red discharge cell or a blue discharge cell, and wherein at least one wall in a red discharge cell is wider than walls in a blue discharge cell.

25. A plasma display panel, comprising:

an upper substrate;

a lower substrate facing the upper substrate;

a plurality of sustain electrodes on the upper substrate;

a plurality of barriers formed on the lower substrate to define a plurality of discharge cells, wherein a sustain electrode corresponding to a predetermined color has a width different from a sustain electrode of at least one other predetermined color.

26. The plasma display panel as claimed in claim 25, wherein a sustain electrode corresponding to a green discharge cell is wider than a sustain electrode corresponding to a red or blue discharge cell.

27. The plasma display panel as claimed in claim 25, wherein a sustain electrode corresponding to a red discharge cell is wider than a sustain electrode corresponding to a blue discharge cell.

28. The plasma display panel as claimed in claim 25, wherein the sustain electrodes corresponding to red, green and blue discharge cells, respectively, have a width ratio of 2:3:1.

29. The plasma display panel as claimed in claim 25, wherein the sustain electrodes corresponding to red, green and blue discharge cells, respectively, have varying widths to improve the purity of a white luminance color.

* * * * *